US011066262B2

(12) United States Patent
Yadav

(10) Patent No.: US 11,066,262 B2
(45) Date of Patent: Jul. 20, 2021

(54) APPARATUS AND METHOD FOR SINGLING SHEET MATERIAL

(71) Applicant: GIESECKE+DEVRIENT CURRENCY TECHNOLOGY GMBH, Munich (DE)

(72) Inventor: Amit Kumar Yadav, Gurgagon (IN)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 259 days.

(21) Appl. No.: 16/334,536

(22) PCT Filed: Sep. 22, 2017

(86) PCT No.: PCT/EP2017/001130
§ 371 (c)(1),
(2) Date: Mar. 19, 2019

(87) PCT Pub. No.: WO2018/054538
PCT Pub. Date: Mar. 29, 2018

(65) Prior Publication Data

US 2021/0070566 A1 Mar. 11, 2021

(30) Foreign Application Priority Data

Sep. 22, 2016 (IN) ..... 201631032393

(51) Int. Cl.
*B65H 3/06* (2006.01)
*B65H 3/48* (2006.01)
(Continued)

(52) U.S. Cl.
CPC ..... *B65H 3/063* (2013.01); *B65H 3/0676* (2013.01); *B65H 3/48* (2013.01); *B65H 7/02* (2013.01);
(Continued)

(58) Field of Classification Search
CPC ..... B65H 3/06; B65H 3/063; B65H 3/0638; B65H 3/0676; B65H 3/10; B65H 7/02;
(Continued)

(56) References Cited

U.S. PATENT DOCUMENTS

2007/0063421 A1* 3/2007 Demmeler ..... B65H 3/06 271/121
2013/0221606 A1* 8/2013 Lai ..... B65H 3/0676 271/34
(Continued)

FOREIGN PATENT DOCUMENTS

DE 102009018085 A1 10/2010
JP 60124283 A * 7/1985 ..... B65H 7/02

OTHER PUBLICATIONS

International Search Report from PCT Application No. PCT/EP2017/001130, dated Jan. 12, 2018.

*Primary Examiner* — Prasad V Gokhale
(74) *Attorney, Agent, or Firm* — Workman Nydegger

(57) ABSTRACT

A singling apparatus and a system for singling sheet material comprises a sheet store for receiving a sheet stack of sheets to be singled. The sheet store includes a singling gap, which is formed and arranged to deliver a sheet out of the sheet store to a transport mechanism. The singling apparatus comprises further a singling device comprising a rotating separation roller wherein the separation roller comprises partially on its rotational surface a contact area to periodically contact and transport the sheet from the sheet store to the transport mechanism. A position control device of the singling apparatus is coupled to the separation roller and comprises an alignment indication being in correlation with an angle position of the contact area of the separation roller and indicates the alignment of the contact area to the singling gap and/or the sheet.

20 Claims, 13 Drawing Sheets

(51) Int. Cl.

| | |
|---|---|
| ***B65H 7/02*** | (2006.01) |
| ***B65H 7/04*** | (2006.01) |
| ***B65H 7/14*** | (2006.01) |
| ***B65H 7/18*** | (2006.01) |

(52) U.S. Cl.
CPC ..... *B65H 7/04* (2013.01); *B65H 7/14* (2013.01); *B65H 7/18* (2013.01); *B65H 2404/1152* (2013.01); *B65H 2511/212* (2013.01); *B65H 2513/10* (2013.01); *B65H 2513/11* (2013.01)

(58) Field of Classification Search
CPC .... B65H 7/04; B65H 7/18; B65H 2404/1152; B65H 2404/117; B65H 2511/212; B65H 2513/11
See application file for complete search history.

(56) References Cited

U.S. PATENT DOCUMENTS

2013/0328260 A1* 12/2013 Matsushita ..... B65H 3/063 271/109
2017/0148248 A1* 5/2017 Xu ..... B65H 7/14

* cited by examiner

APPARATUS AND METHOD FOR SINGLING SHEET MATERIAL

BACKGROUND

The present invention relates to a singling apparatus and a method for singling sheet material. Conventional singling apparatus comprise a sheet store for receiving a stack of sheets to be singled. The sheet store includes a singling gap to deliver a single sheet out of the sheet store to a transport mechanism. A singling device is adapted to separate the sheet of the stack of sheets. The singling device comprises a rotating separation roller. The separation roller comprises partially on its rotational surface a contact area to periodically contact and transport the sheet to be separated from the sheet store to the transport mechanism.

Singling apparatus are broadly used for singling stack of sheets. Some singling apparatus use wheel singler. A wheel singler uses a separation roller comprising a frictional contact area to contact and transport the sheet to be separated to a transport mechanism. In another embodiment the wheel may use a sectional contact area having perforations to exert suction force to the sheet to be separated. With rotational movement of the separation roller it moves the contacted sheet to the transport mechanism for delivering to further processing station. Other sheets remain in the sheet store.

Singling apparatus are used for rapid singling a stack, in particular bundles, of e.g. bank-notes in transverse or longitudinal direction, so that the singled note can be supplied to sensor system for determining its properties and in particular to determine its genuineness, denomination, value, fitness and other characteristic properties of the note.

Sheets in the sense of the invention are any sheet like articles. Preferably, the sheet like articles are value documents, representing monetary, ideological and/or authorizational value, e.g bank notes, cheques, tickets, passports or ID-documents, made of paper, plastics or a combination thereof.

For separation of sheet like articles the separation roller of the singling apparatus rotates in separation direction. With each rotation the sheet to be separated is transported towards the transport mechanism. At start of singling apparatus the separation roller has to reach a minimum target speed of rotation to pull off the sheet to be separated from the stack. The minimum target speed ensures that the sheet will not crumble when pulling off the stack. Furthermore a correct delivering of the sheet to the transport mechanism is ensured.

To reach the minimum target speed at machine startup the separation roller will be aligned to a start position. To align the separation roller to the angular start position the separation roller rotates in separation direction. The separation roller comprises a sensor for detecting the arrival to the angular start position. In particular break down of the singling apparatus or not-controlled shut down of the singling apparatus during separation process may cause the separation roll to be in contact with the sheet to be separated at break down or shut down, e.g. due to critical situation like stacker full and/or sheet jam, after restart of the singling apparatus the separation roller starts to rotate in separation direction. In practice the rotational speed of the separation roller does not reach the minimum target speed. This might result in a failure of the singling apparatus, e.g. tearing or crumbling the sheet, due to speed of transport mechanism does not match with speed of separation roller. To overcome the problem the separation roller can rotate against separation direction. However, then the separation roller pushes the sheet back to the stack. The inevitable result is that the sheet will be crumbled.

SUMMARY

Hence, there is a need to improve existing singling apparatus. In particular the problem of the present invention is to provide a singling apparatus, wherein transport and delivering of sheets from the separation roller to the transport mechanism is ensured without failure. The process of separation should be reliably after a long operating time as well as immediately after startup and/or restart of singling apparatus.

According to a first aspect of the invention the singling apparatus comprises a position control device. The position control device is coupled to the separation roller and comprises an alignment indication. The alignment indication is in correlation with an angular position of the contact area of the separation roller and indicates the alignment of the contact area, in particular the alignment of the contact area relating to the singling gap of the sheet store and/or to the sheet to be singled.

Positional detection of alignment indication of separation roller is used to assume contact between separation roller and the sheet to be separated. Moreover the alignment indication indicates whether rotation of the separation roller is possible without causing distress in separation, delivering and/or transporting the sheet to be singled due to transport and/or deliver the sheet in direction towards the stack and/or sheet store. Furthermore alignment indication provides the singling apparatus information after start up or restart of singling apparatus if alignment of separation roller to a start position is possible. The start position is an angular alignment of separation roller at which a start-up-acceleration is sufficient to achieve the minimum rotational speed for assured singling process. The alignment indication shows a relative position preferably a relative angular position of the separation roller to the sheet to be separated.

In accordance with the present invention the singling apparatus obtains information how to process with the separation roller whether to align the separation roller to the start position is possible, the separation roller seems to be aligned in start position and/or alignment of separation roller seems to cause trouble due to contacting the sheet. Furthermore the singling apparatus obtains further information if manual operation is necessary, e.g. to pull out a sheet of the singling apparatus due jamming.

The present invention provides a method to determine the current alignment of separation roller in particular at start-up or restart of singling apparatus. The result enables to determine if the separation roller may be rotated against separation direction, if the separation roller is in start position, if the separation roller should not rotate against separation direction or is allowed to rotate in separation direction, e.g. to rotate to start position.

In a preferred embodiment the position control device comprises a rotatable position control roller. The alignment indication is arranged on the position control roller and can be sensed by a detection unit. The position control roller may be integrally formed with the separation roller. In one embodiment, the position control roller uses the same rotational axis as separation roller.

In another embodiment, the position control roller is arranged separate to the separation roller at the singling apparatus. The position control roller is preferably coupled to the separation roller, most preferably via mechanical coupling. The mechanical coupling can be performed via belt, chain or gear. Further the mechanical coupling can be performed via direct connection of position control roller and separation control roller.

The design of a position control roller to indicate the angular position alignment of separation roller enables a simple correlation of angular position of separation roller to alignment indication formed on position control roller. E.g. in accordance with the angular position of the alignment indication the detection unit indicates the angular position of separation roller without complex calculation e.g. transformation of measured values, in particular length.

If the position control roller uses the same axis as the separation roller no transmission ratio has to be considered.

The contact area is formed on a rotational surface of the separation roller. The contact area defines with the axis of the separation roller an angle of contact. A spatial extension of the alignment indication defines an angle of alignment. In a preferred embodiment the angle of alignment correlates with the angle of contact. In an embodiment, the extension of the angle of alignment is at least the dimension the angle of contact. More preferable, the angle of alignment overlaps the angle of contact.

In a preferred embodiment the alignment indication comprises a cavity, a recess, a reflecting area, an area of material thinning an area of material compacting a magnetic marking, an electrical marking a colored marking and/or surface treatment.

In a further preferred embodiment the alignment indication is formed as a recess e.g. at a face side of the separation roller or position control roller. The alignment indication extends at a circular arc to its axis. The recess is formed optically transmissible and light can pass through the recess. The recess may comprise a filter element to modify light coming through the recess, e.g. change color and/or brightness.

Furthermore the alignment indication may be formed as a gap. The gap may differ by how much the gap is covered e.g. by a covering element and/or the body of alignment indication. A detection unit may detect the presence of the gap and/or its coverage to get information about relative position of alignment indication.

Furthermore the alignment indication may have a reflecting area to indicate the position of the separation roller. The reflecting area may be formed to reflect optical waves, in particular infrared or visible light. The reflecting area may be made of metal, glass or any other reflective material or surface.

In an embodiment the alignment indication may comprise a material thinning and/or material compacting, e.g. an area having a density different to the surrounding area of the alignment indication.

In an embodiment the alignment indication may be formed as/with special surface treatment differing to the surround area. The surface treatment can be performed by roughening.

The detection unit obtains the presence of the alignment indication and its characteristics to obtain the state of the separation roller, in particular its alignment, e.g. if the contact area is aligned to the singling gap and/or to the sheet, as well any other alignment status e.g. the distance the separation roller transported the sheet to the transport mechanism. The alignment indication may comprise different sub-properties, e.g. different material densities and/or opacity. In an embodiment the alignment indication may comprise a combination of the above mentioned different properties.

In an embodiment the alignment indication is in the form of a circular arc or a segment of a circle. In a preferred embodiment the alignment indication is in a form of the combination of the circular arc and segment of a circle. Preferably, the center of the arc and the circle, respectively is the same as the axis of the separation roller.

In preferred embodiment the singling apparatus comprises furthermore a sensor device. The sensor device is adapted to identify the alignment of the alignment indication, in particular an angular position of the alignment indication and/or the presence of the alignment indication at a defined position. The sensor device may be a separate external unit to the apparatus. The sensor device may include the detection unit or may be coupled to the detection unit. In some cases the sensor device may be part of the position control device. The sensor device obtains the alignment, in particular relative angular alignment, of the separation roller due the alignment of the alignment indication. The sensor device may comprise a signal generator. The signal generator may generate a signal, e.g. light beam and/or ultrasonic beam. The signal can be a digital signal and comprise data. Preferably, the sensor device is part of the detection unit and adapted to detect the signal. The detection unit and sensor device, respectively, analyses the detected signal. The result of the analysis can represent that the contact area of the separation roll is not oriented to the sheet and/or singling gap. The detection unit may provide a controller the analysis result. The controller determines, if at singling apparatus start-up or restart the separation roller is requested to rotate against separation direction, the separation roller is in start position, the separation roller is requested to rotate in separation direction or manual support is requested. The controller may retrieve information from other components of singling apparatus and/or processing device coupled with the singling apparatus. The controller may be integrated in the processing device, e.g. banknote processing device.

It should be noted that the term start position may be exact alignment of the separation roller. The start position may also cover a section of angular alignment positions of the separation roller, in which separation of a sheet from a stack of sheet and its delivering to the transport mechanism is ensured.

In an embodiment the spatial extension of the alignment indication is the same as the spatial extension of the contact area. More preferable, the angular extension of the alignment indication is the same as or more than the angular extension of the contact area. So, the angle of alignment defined by the angular extension alignment indication to its center, e.g. rotational axis of the position control roller, is the same as or more than an angle of contact defined by the angular extension of the contact area. With this arrangement the complete contact area presumably contacting the sheet can be observed. In particular according to the more preferable embodiment an imaginary security area is added to the observed contact area by extension of alignment indication. The security area can cover tolerances of indication both before and after presumable contacting the sheet. Furthermore the start position can be defined at a position where run-up of the separation roller to a minimum target speed is ensured. The start position can be at an area when the achievement of minimum target speed is ensured and the contact area nearly does not contact the sheet after presumable contacting and transporting a sheet, respectively. The extension of the start position area may be decreased by adjustment of its limits and implementation of the security area.

In a preferred embodiment, the singling apparatus comprises a feeding mechanism. The feeding mechanism is adapted to feed at least one sheet to be separated towards the separation roller. The feeding mechanism is in general not used and adapted to separate a sheet from the stack of sheets. The feeding mechanism can comprise an air feeding mechanism and/or a feeding roll. The air feeding mechanism exposes air pressure to the stack of sheets, in particular the sheet to be separated. The air pressure lightens the stack and/or forces the sheet to be separated to move toward the separation roller.

The feeding roll is rotationally arranged in the feeding mechanism. The feeding roll comprises a feeding element, at least partial arranged on the rotational surface of the feeding roll. The feeding element can be a frictional pad to apply frictional force at least to the sheet to be separated to move toward the separation roller. In another embodiment the feeding element can be an air assisted feeding element. The air assisted feeding element uses suction force to the sheet to be separated to force this sheet to move toward the separation roller. The feeding element feeds the sheet to be singled periodically to the singling gap and the separation roller.

Preferably, the alignment indication of the position control device indicates the status of the feeding mechanism, in particular whether the feeding mechanism presumably contacts the sheet to be separated (feeding indication). In a preferred embodiment the alignment indication represents the feeding indication when contacting the sheet. In particular, when the feeding mechanism is coupled with the separation roller, i.e. the feeding mechanism movement is coupled with the movement of the separation roller, the detection unit obtains an information if the separation roll is allowed to rotate against separation direction without moving the sheet in a direction opposite to the separation roller by the feeding mechanism. This could result in sheet crumble and jam in sheet store and singling device. This preferred observation ensures singling of sheets using a feeding device.

Preferably the sheet movement by feeding device is synchronous with the transport and rotary velocity of the separation roller. In one aspect the alignment of the feeding device, in particular feeding element, to the sheet can be mapped easily to the alignment indication. No further calculations are necessary. In a second aspect, the mechanical construction in the singling apparatus is in clear arrangement. In particular position control device can be coupled to feeding device in easy way, without complex junctions.

In a preferred embodiment the sheet store comprises a level measurement device. The level measurement device senses the presence of at least one sheet in the sheet store and/or at the singling gap. In particular when singler apparatus stops due to unusual operational conditions, e.g. stacker full or sheet jam, the separation roller does not rotate to start position.

In case the alignment indication results that the separation roller is aligned to the singling gap and/or to the sheet for the decision to rotate the separation roller against separation direction it is useful to retrieve information on presence of a sheet in singler device and/or sheet store. In case there is no sheet in the singler device and/or in the sheet store the separation roller and/or feeding roller cannot contact any sheet although the separation roller and/or feeding roller are aligned to presumable sheet. The separation roller and/or feeding roller are allowed to rotate both in separation direction and against separation direction start position.

Otherwise, knowledge about the amount of sheets in sheet store could be helpful, e.g. if in case the alignment indication indicates that the separation roller is aligned to the singling gap and/or to the sheet. If there is a small amount of sheets, the sheet in contact with the separation roller might be transported by the separation roller against separation direction back to the stack without getting crumbled, e.g. using a sheet stack in which the sheets are stacked above the sheet to be separated.

Furthermore the weight force of the sheet stack could influence the velocity of the separation roller and feeding roller, if available, and so the angular position of start position. The position of start position may be simply adapted by variable formation of alignment indication and sensing the different properties of areas of the alignment indication. At least to areas have different properties, e.g. in transmission and/or color. The detection unit obtains e.g. information that the separation roller is not oriented to the sheet. According to the amount of sheets in sheet store the current alignment of separation roller is enough for ensured separation and delivering to transport mechanism without failure.

A second aspect of the invention relates to a method for singling sheet material in a singling apparatus. The singling apparatus comprises a sheet store to receiving a sheet stack of sheets to be singled. The singling apparatus further comprises a singling device. The singling device comprises a rotating separation roller having partially on its rotational surface a contact area to periodically contact and/or transport the sheet for separation out of the sheet stack while rotating the separation roller in a transport rotary direction. The singling apparatus further comprises a position control device coupled to the separation roller and comprising an alignment indication. The alignment indication roller is in correlation with an angle of alignment of the contact area of the separation roller and indicates the alignment of the contact area to the sheet. In particular the alignment indication indicates the status of the contact area whether contacting and/or transporting the sheet. The method comprises the step of sensing the position of the alignment indication of the position control device. A further step includes evaluation of the sensed position of alignment indication, in particular whether the contact area is or seems to be in contact with the sheet. If the evaluation results that the contact area is not contacting and/or not transporting the sheet, the separation roller will be rotated against the transport rotary direction until the separation roller is aligned to a start position. The start position is defined as an angular position of the separation roller in which after start to rotate the separation roller in separation direction it is ensured to reach a predefined minimum angular velocity when the contact area contacts the sheet. After the separation roller is in start position the separation roller starts to rotate the separation roller in separation direction (transport rotary direction) to start singling sheets from the sheet store.

Arrival of the start position may be detected by a special event. The event can be a sensed change of an analogue value, e.g. wavelength or transmission rate, or a digital value, e.g. presence of light or electrical signal or a combination thereof. In a preferred embodiment, the start position is sensed by edge detection logic, i.e. by a digital change of detection of an end of spatial extension of alignment indication. For example, the alignment indication is formed as a recess and the alignment indication is sensed by presence of light beam. Alignment of separation roller in start position is sensed by change of light beam detection. E.g., exact at this transition the start position is reached.

The above mentioned filling level meter is used to determine the presence of a sheet in the sheet store and/or in the singling device. Furthermore, the filling level meter can be used to determine the amount of sheets in the sheet store and/or the weight of the sheet stack in the sheet store. In a preferred embodiment when the evaluation of the position of alignment indication results that the contact area seems to be in contact with the sheet and/or is transporting the sheet, because the contact area of the separation roller is oriented to the singling gap, in a first aspect the separation roller rotates against the transport rotary direction (separation direction) until the separation roller is aligned to the start position when the determined filling level results that there is no sheet to be singled in the singling device and/or the sheet store. Otherwise, in a second aspect the separation roller will not rotate against the transport rotary direction when the determined filling level results that there is at least one or a defined amount of sheets in the singling device and/or sheet store. Then the singling apparatus will proceed with start to rotate the separation roller and separate the sheet from the sheet store. In a more preferred embodiment the singling apparatus will not proceed with start to separate but will wait for manual operation, e.g. to remove the sheet manually out of the singling device, to confirm and start separation and/or to rotate the separation roller manually either in separation direction or against separation direction.

The present invention reduces the requirement of user intervention, when singler apparatus is not in start position at start-up or restart. Furthermore the present invention reduces failures in the singler apparatus and/or in particular banknote processing systems because the sensors work best when the speed of sheets in the transport mechanism is constant and stable. Transporting sheets from the separation roller in a first speed and transporting the sheets with the transport mechanism in a second speed may result in a jerking movement of the sheet. Correct working of the sensors would not be ensured. Furthermore according to the present invention the sheets to be separated will get skewed, damaged, torn or soiled.

BRIEF DESCRIPTION OF THE DRAWINGS

Although the invention will hereinafter be described in more detail with reference to the accompanying drawings by the example of the singling of bank notes, it is not restricted to this application. Any kind of sheet material can be singled in the way described hereinafter, in particular value documents other than bank notes, such as checks, shares, tickets and the like. The figures are described as follows.

DETAILED DESCRIPTION OF VARIOUS EMBODIMENTS

Figure 1:
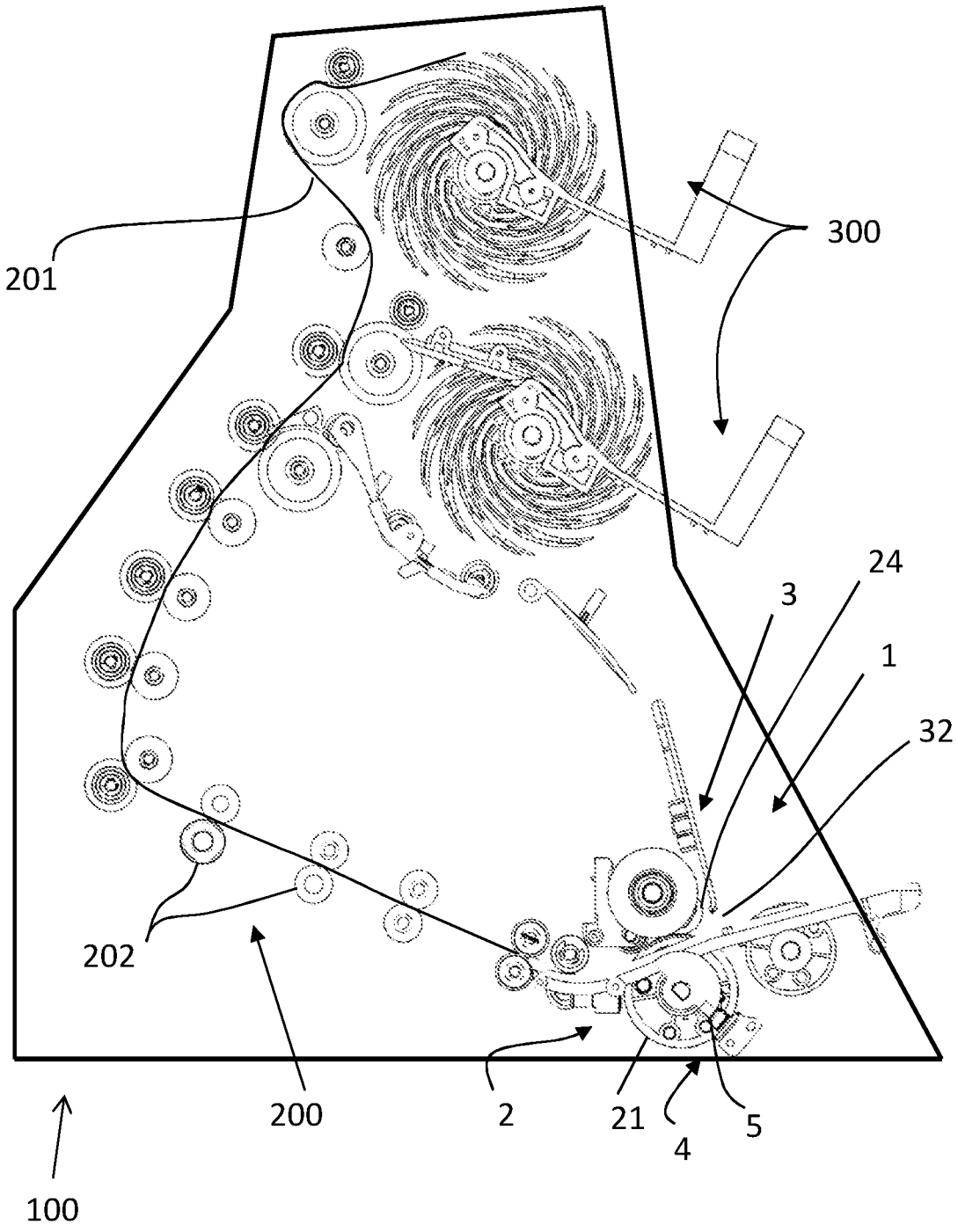
FIG. 1 shows schematically and exemplary an apparatus for processing bank notes.

FIG. 1 shows schematically a machine 100 for processing bank notes. The machine 100 comprises a singling apparatus 1. The singling apparatus 1 comprises a sheet store 3 for receiving a sheet stack, e.g. a number of bank notes. A singling device 2 of the singling apparatus 1 singularizes the bank notes out of the sheet store 3 and delivers a singled bank note to a transport mechanism 200. The transport mechanism 200 comprises a plurality of transport rollers 202. The transport mechanism 200 transports each bank note along a transport route 201. Along the transport route 201 there are sensing devices (not shown) to sense the transported bank note and to evaluate the transported bank note e.g. according its denomination, genuineness and/or fitness. In correspondence of the evaluation result the transport mechanism 200 transports the evaluated bank note to a defined output receptacle 300.

In detail the sheet store 3 comprises at an end and directed to the singling device 2 and transport mechanism 200 a singling gap 32. A feeding roll 63 of a feeding mechanism contacts the lowest bank note of the sheet stack and feeds this bank note in the direction of the singling gap 32. At the singling gap 32 the singling device 2 contacts the bank notes of the sheet store 3 using a separation roller 21 and deliver it to the transport mechanism 200. At the opposite side of the singled bank note there is a retaining element 24. The retaining element 24 prevents other bank notes of the sheet stack to be delivered by the separation roller 21.

Near the separation roller 21 there is a position control device 4. The position control device 4 indicates the working status of the separation roller 21 and its orientation, in particular whether the separation roller 21 seems to deliver the bank note to the transport mechanism 200. A sensor device 5 senses the position control device 4 and recognizes the working status and/or orientation of the separation roller 21.

With start of the machine for processing bank notes 100 but before start of the separation roller 21 to rotate and separate the bank notes of the sheet stack a controller checks if there is already a bank note in the singling device 2 and/or if the separation roller 21 has enough time for start-up to reach an minimum angular velocity for separation of bank notes.

If the controller decides that there would be not enough time and distance to accelerate the separation roller 21, the separation roller 21 turns in a direction against the delivering direction to start position to start separation. With aligning the separation roller 21 to singularize the sheet stack at the start position it is ensured that the rotation velocity of the separation roller 21 will be enough for appropriate and reliable separation of bank notes. The bank notes will not tear and a bank note jamming will not occur in the singling device 2.

Figure 2A:
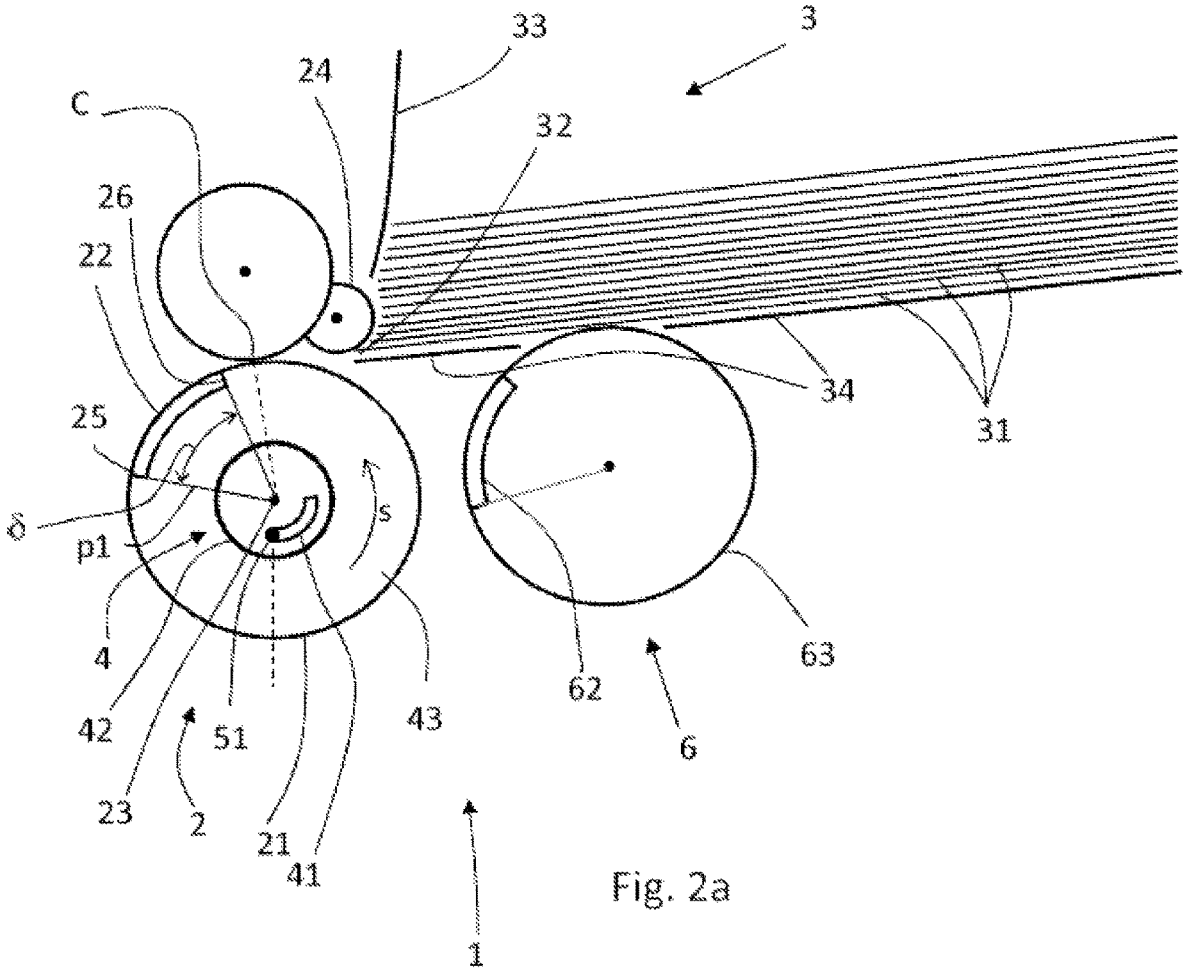
FIG. 2*a, b* show schematically a singling apparatus according a first embodiment in start position.

FIG. 2*a* shows schematically a singling apparatus 1 according a first embodiment in start position.

The singling apparatus 1 may be like the singling apparatus 1 of the machine for processing bank notes 100 in FIG. 1. The singling apparatus 1 may also be part of any other sheet processing machine.

The singling apparatus 1 comprises a sheet store 3. The sheet store 3 is able to receive a stack of sheets 31, e.g. bank notes, to be singularized by the singling apparatus 1. In this exemplary embodiment the sheet store 3 is formed as a vessel having at least one sidewall 33 and a ground plate 34. The sheets 31 of the stack rest on the ground plate 34.

At a lower end of the sheet store 3 there is a singling gap 32. The singling gap 32 is an opening to leave the lowest sheet 31 out of the sheet store 3 to a singling device 2. A feeding roll 63 of a feeding mechanism 6 contacts the lowest sheet 31 through a recess in the ground plate 34 of the sheet store 3 and feeds this sheet 31 toward the singling gap 32. The feeding roll 63 comprises on its circumferential rotational surface a frictional feeding element 62. The feeding element 62 is arranged only partial on the surface of the feeding roll 63 to perform not permanently feeding activities to sheets 31 of the sheet store 3 while rotating. Hence the feeding roll 63 feeds the lowest sheet 31 periodically. Preferably, the regional extension of feeding element 62 on the rotational surface is such that with feeding the lowest sheet 31 to the singling device 2 (feeding direction) the singling device 2 will contact and transport this sheet 31.

The singling device 2 comprises a separation roller 21 to contact the sheet 31 fed from the sheet store 3 for separation. In this embodiment the separation roller 21 comprises on its circumferential rotational surface a contact area 22 to contact the sheet 31, separate the sheet 31 and deliver the sheet 31 for further processing (not shown). The contact area 22 is partially arranged on the rotational surface of the separation roller 21. So, in this embodiment the separation roller 21 delivers periodically singularized sheets 31 to following processing mechanism. For appropriate separation of sheets, the singling device 2 further comprises a retaining element 24, e.g. according this embodiment a retaining roller 24. The retaining roller 24 ensures that only one sheet 31 is able to be fed to the separation roller. The retaining roller 24 is located at the singling gap 32 at a side of the fed sheet 31 opposite to the separation roller 2 and rotates in a counter direction to the feeding direction. The retaining roller 24 contacts sheets 31 arranged above the sheet 31 to be singularized and exert a force to this above arranged sheets 31 for retaining them in the sheet store 31. A rotational separation direction s of the separation roller 21 is defined as a rotational direction wherein the separation roller 21 separates a sheet 31 from the stack of sheets 31 and delivers the singularized sheet 31 downstream to processing by rotation. In view of the separation rotational direction s the contact area 22 comprises a first end 25 and a second end 26 of the contact area 22, wherein at the first end 25 is defined as the beginning boundary of the contact area 22 and the second end 26 is defined as the end boundary of the contact area 22.

The singling apparatus 1 comprises a position control device 4. The position control device 4 comprises a position control roller 42. The position control roller 42 is mounted on an axis 23 of the separation roller 21 defining a common axis 23. The position control roller 42 is coupled to the separation roller 21 by the axis 23. Rotational movement of the separation roller 21 correlates to the rotational movement of the position control roller 42.

Figure 2B:
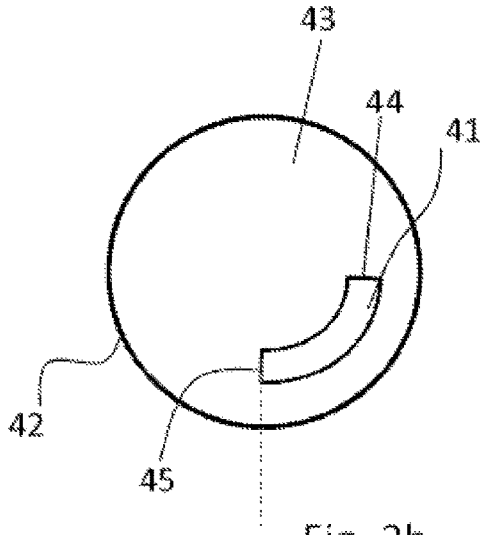

The position control roller 42 comprises an alignment indication 41. In the embodiment shown in FIG. 2*a* the alignment indication 41 is located at the front side 43 (base area) of the position control roller 42. FIG. 2*b* shows the position control roller 42 of FIG. 2*a* in detail and can be viewed in combination. The alignment indication 41 is a recess formed in the position control roller 42. In an alternative embodiment the alignment indication 41 may be a cavity or a coating, e.g. forming a reflective material, a magnetic marking, a colored marking, wherein the marking comprises color pigments, luminescent pigments and/or phosphorescent pigments. Further, the alignment indication 41 may have a defined electrical conductive and/or magnetic attributes. Alternatively, the alignment indication 41 may be a material thinning or material thickening at an area of the position control roller 42.

The separation roller 21, feeding roll 63 and position control roller 42 are coupled to each other and therefore have the same angular velocity.

FIG. 2*a* shows the singling apparatus in start position. Point C defines a contact Point. At the contact point the separation roller 21 is able to contact the sheet to be separated. The contact area 22 of the separation roller 21 is not contacting the next sheet to be singled. FIG. 3*a* shows the separation roller 21 and position control roller 42 of FIG. 2*a*. FIG. 3*b* shows the feeding roll 63 of FIG. 2*a* and FIG. 2*c* shows the position control roller 42 of FIG. 2*a*.

The position alignment of the first end 25 defines the start position alignment (line p1) of the contact area 22. The angle of contact $\delta$ is defined by an angle in which the contact area 22 extends on the circumferential surface of the separation roller 21.

The feeding element 62 of the feeding roll defines analogously to the separation roller 21 a first end 64 and a second end 65 in accordance to the extension of the feeding element 62. An angle of feeding $\varepsilon$ is defined by an angle in which the feeding element 62 extends on the circumferential surface of the feeding roll 63. The alignment indication 41 of the position control roller 42 forms an arc-segment and comprises in separation rotational direction s a first end 44 and a second end 45. An angle of transport $\beta$ is defined by an angle which is made by the first and second end 44, 45 of the alignment indication 41.

Figure 3C:
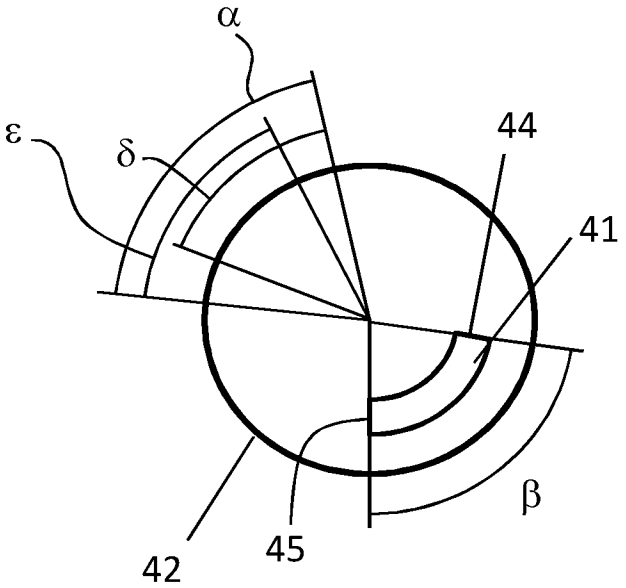
FIG. 3*a, b, c* show a separation roller, a position control roller and a feeding roll according FIG. 2*a, b*
Figure 3B:
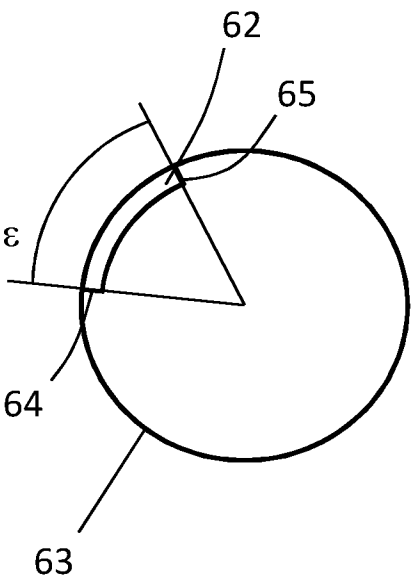
Figure 3A:
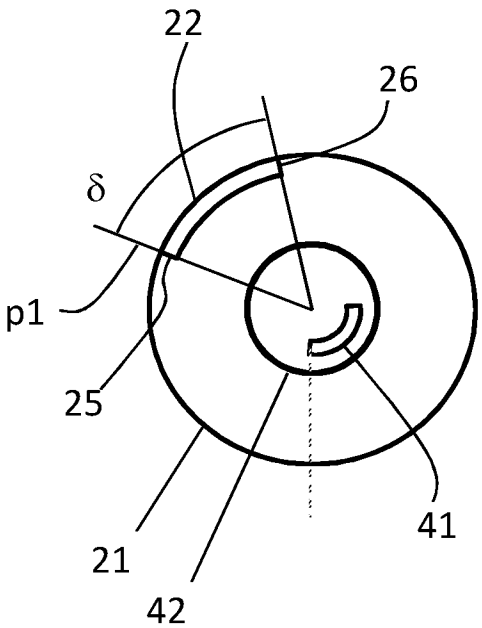

FIG. 3*c* indicates the proportions and angular positions of contact area 22, alignment indication 41 and feeding element 62 in combination with FIGS. 2*a, b*. As can be seen, in separation rotational direction s the first end 25 of the separation roller 21 is behind the first end 64 of the feeding roll 62. In process to separate sheets 31 of the sheet store 3 first the feeding mechanism 6 has to contact and feed the sheet(s) 31 in the direction of the singling gap 32 so that the singling device 2, i.e. the separation roller 21, is able to contact the lowest fed sheet 31 for singularizing and delivering for further processing. Thus, the first end 64 of the feeding roll 62 is preferably ahead the first end 25 of the separation roller 21 and the second end 54 of the feeding roll 6 is ahead the second end 26 of the separation roller 21. The singling apparatus contacts the sheet 31 to be singled from that time when the feeding mechanism 6 touches the sheet 31 until the contact area 22 leaves contact to the sheet 31 (with second end 26 of contact area 22). An angle of touching $\alpha$ is a combination of angle of transport $\delta$ and angle of feeding $\varepsilon$.

The angular extension of alignment indication 41 matches in this embodiment with the angle of touching $\alpha$. The alignment indication 41 is able to indicate if the singling apparatus 1 is in contact with a sheet for feeding, separating and delivering by the feeding mechanism 6 and singling device 2. A sensor device can be used to detect the position of the alignment indication. The sensor device comprises an optical photo sensor 51, sensing the presence of the alignment indication 41. The sensor device is located at the position of alignment indication 41. The position of the sensor 51 is calibrated with the second end 45 of the alignment indication 41 and detects the transition of presence to non-presence of the alignment indication 41 to determine start position of separation roller 41. For example, the photo sensor 51 may comprise a light source, e.g. laser diode, and a photo diode as optical receptor and photo relay. If the sensor 51 detects the above mentioned transition it is interpreted as being at or reached start position.

Figure 4A:
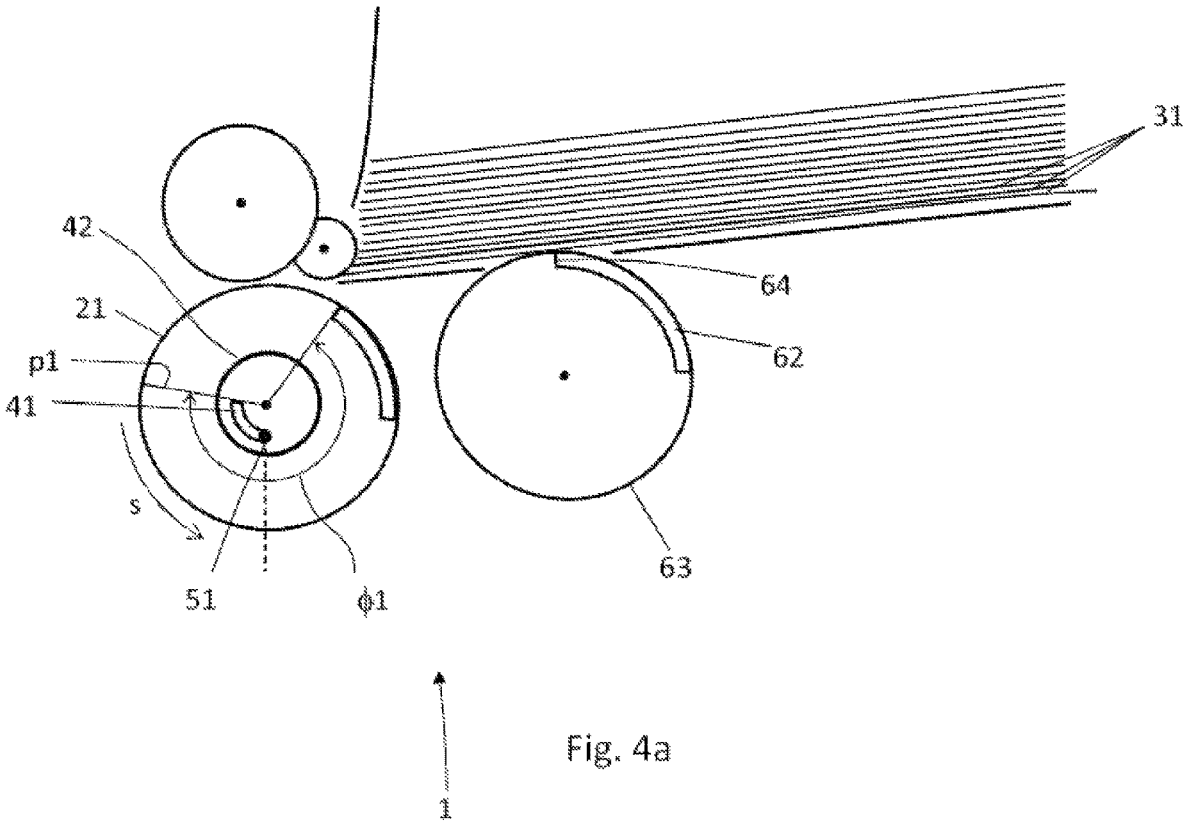
FIG. 4*a, b* show schematically the singling apparatus of FIG. 2*a, b* in a first singling position.
Figure 4B:
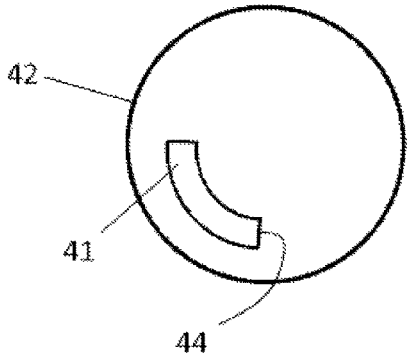

FIGS. 4*a, b* show schematically the singling apparatus 1 shown in FIGS. 2*a* to 3*c* during separation process in a situation when the singling apparatus 1 first contacts the stack of sheets 31 in a singling period, e.g. after rotation the separation roller 41 in separation direction s until the singling apparatus 1 touches the sheet 31 to be separated. I.e., the first end 64 of the feeding element 62 of the feeding roll 63 contacts the lowest sheet 31 of the stack of sheets 31. A first angle of rotation $\phi_1$ describes the rotation angle from the start position line p1. During rotation of the separation roll 21 in separation direction s from the start position in first angle of rotation $\phi_1$ the sensor 51 detects no presence of alignment indication 41 because there is no recess arranged in the sensed area. With reaching the first angle of rotation $\phi_1$ the sensor 51 detects a transition of alignment indication 41, i.e. the sensor 51 detects the first end 44 of the alignment indication. This event is interpreted as first contact of singling apparatus 1 to the lowest sheet 31.

Figure 5A:
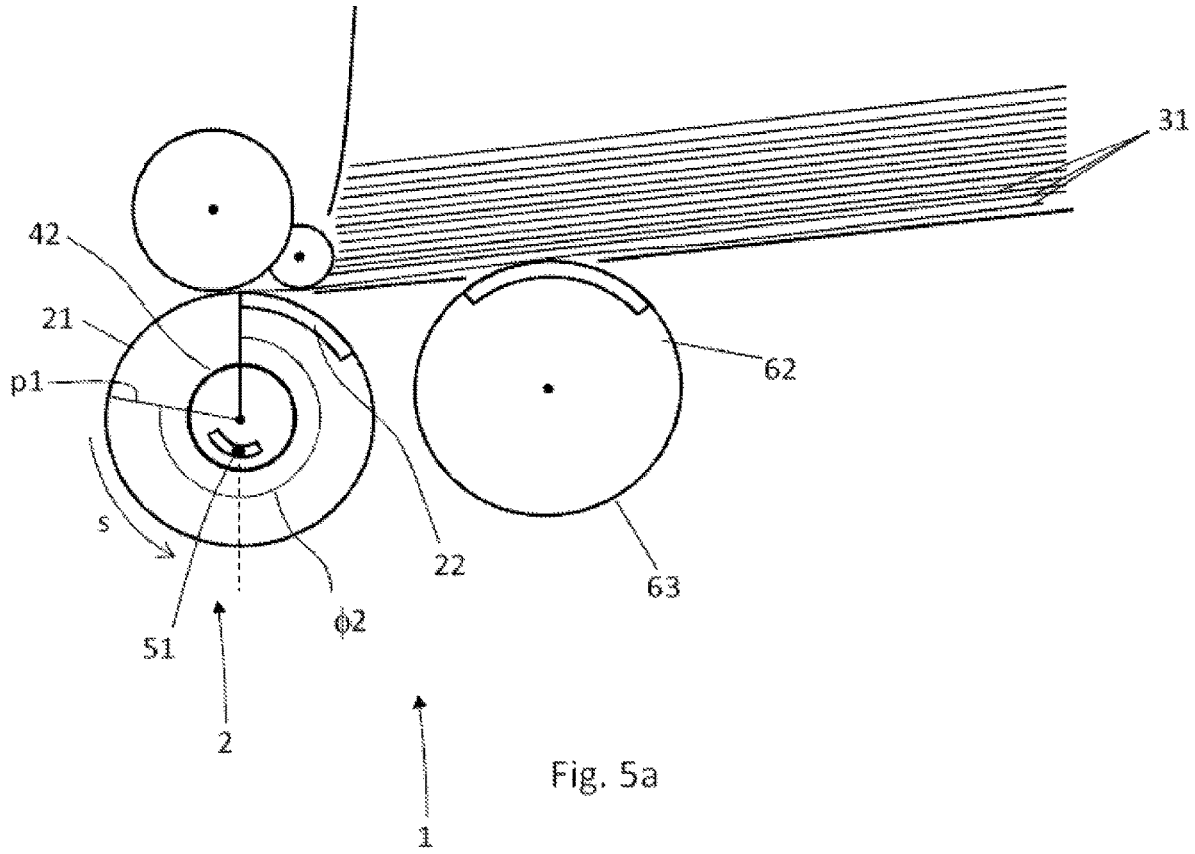
FIG. 5*a, b* show schematically the singling apparatus of FIG. 2*a, b* in a second singling position.
Figure 5B:
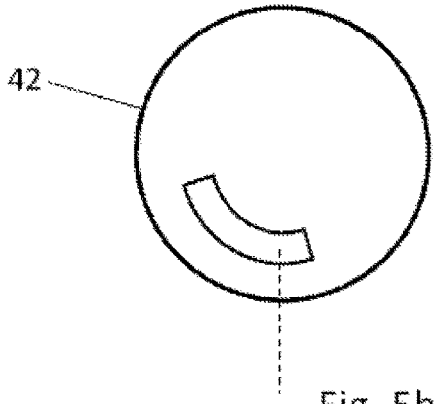

FIGS. 5*a, b* show the singling apparatus 1 according to FIGS. 2*a* to 4*b* during separation process in a situation when the contact area 22 of the separation roller 21 first contacts the sheet 31 fed by the feeding roll 63. A second angle of rotation $\phi_2$ describes the current angle of rotation from start position line p1. During rotating the separation roll 21 in separation direction s from the position shown in FIGS. 4*a, b* to the position shown in FIGS. 5*a, b* the sensor 51 is still detecting the presence of alignment indication 41. This will be interpreted that a sheet 31 is in the singling device 2 and the singling apparatus 1 currently contacts, feeds, transports and delivers the sheet 31.

Figure 6A:
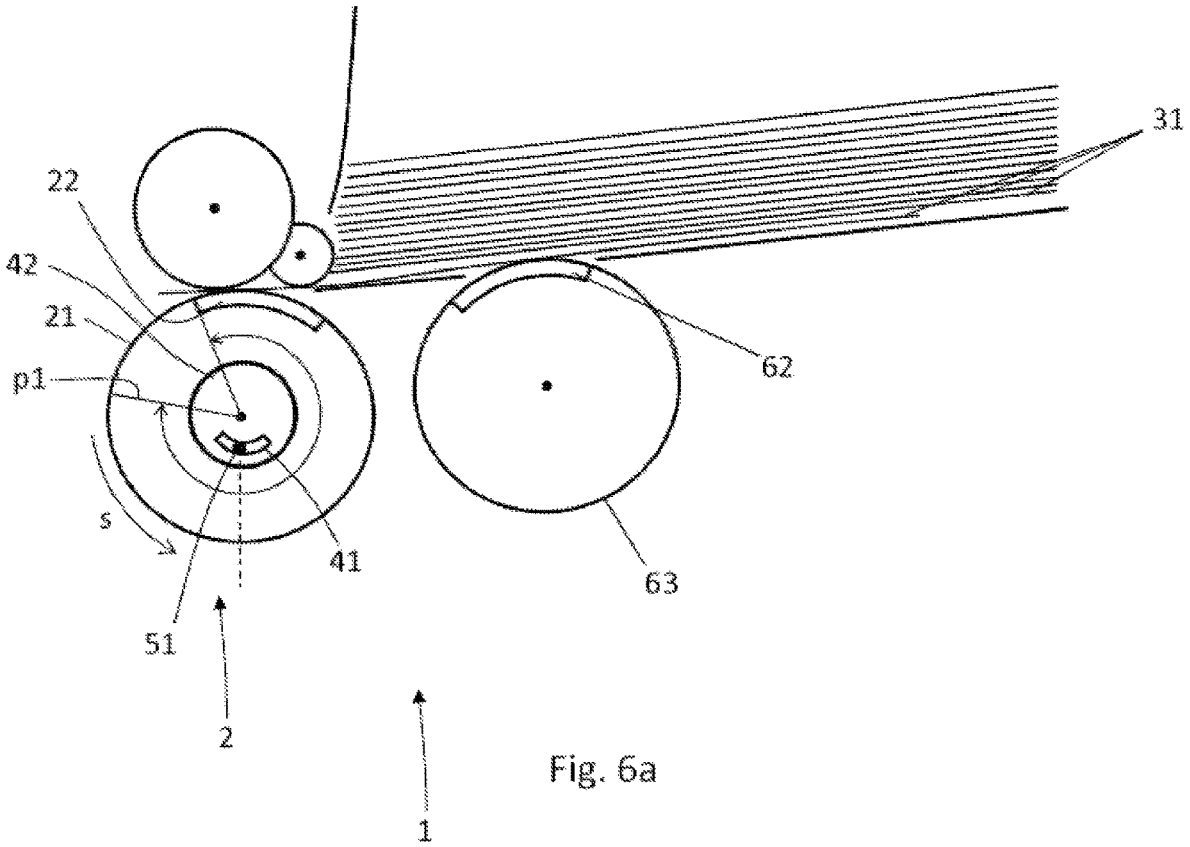
FIG. 6*a, b* show schematically the singling apparatus of FIG. 2*a, b* in a third singling position.
Figure 6B:
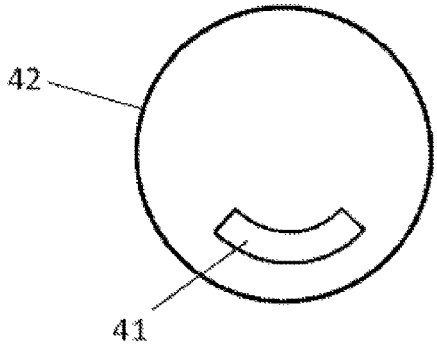

FIGS. 6*a, b* show the singling apparatus 1 according to FIGS. 2*a* to 5*b* during separation process in a situation when the feeding element 62 of the feeding roll 63 is feeding the sheet 31 and the contact area 22 of the separation roller 21 is delivering the sheet 31. The sensor 51 is still detecting the presence of the alignment indication 41. Thus it is interpreted that there is a sheet 31 in the singling device 2.

Figure 7A:
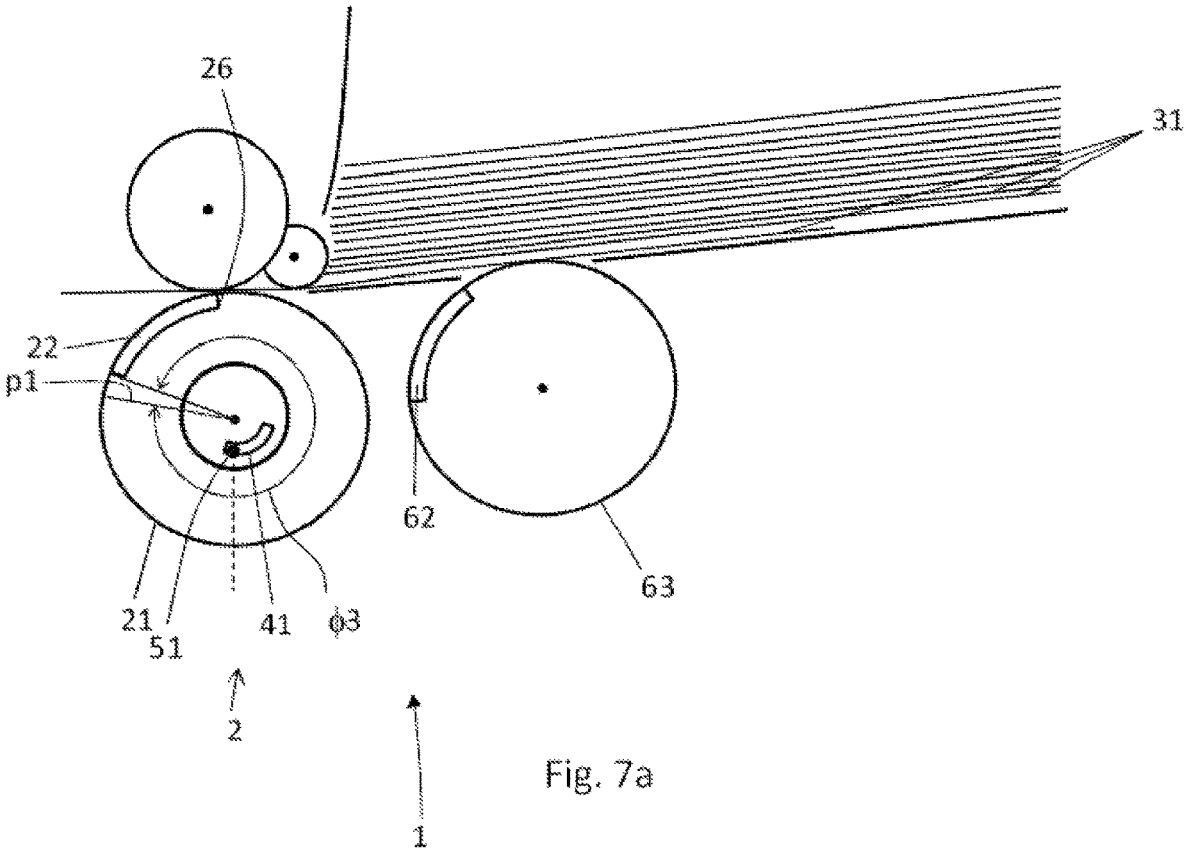
FIG. 7*a, b* shows a singling apparatus according a second embodiment of the invention in perspective view.
Figure 7B:
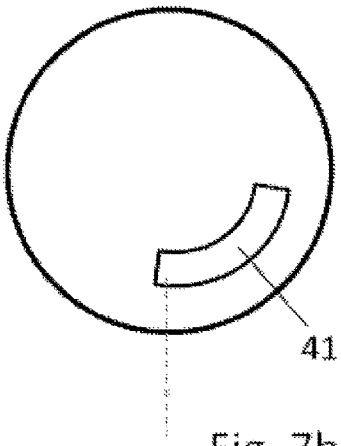

FIG. 7*a, b* show the singling apparatus 1 according to FIGS. 2*a* to 6*b* during separation process in a situation when the second end 26 of the contact area 22 of the separation roller 21 is just contacting the sheet 31 to be delivered by the separation roller 21. The feeding element 62 has already lost its contact to the sheet 31. A third angle of rotation $\phi_3$ describes the actual angle of rotation from the start position line p1. At the third angle of rotating $\phi_3$ the sensor 51 is still detecting the presence of alignment indication 41. Thus it is interpreted that there is a sheet 31 in the singling device 2.

When the separation roller 21 continues to turn the sensor 51 still detects the presence of the alignment indication 41 until the start position line p1 is reached. Then the sensor 51 detects the start position with a detected transition of presence of alignment indication 41 to non-presence of alignment indication 41 (see FIGS. 2*a*-3*c*). The angular range between the third angle of rotation $\phi_3$ and start position line p1 may be set individually. In particular this angular range is dedicated to set the angular position of the separation roller to the start position. Otherwise, there might be set a safety value to ensure that sheet 31 is not contacted by contact area 22 and feeding element 62.

After the separation roller 21 reaches the start position line p1 and therefore the start position the separation process may start with separating the next sheet 31 of the stack of sheets 31 according FIGS. 2*a* to 3*c*.

When starting the separation process at start-up or restart of the singling apparatus 1 the singling apparatus 1 is monitored. In particular it is determined whether a sheet 31 is to be contacted and/or delivered by the singling device and/or a sheet 31 is to be fed by the feeding mechanism 6. The start position ensures that at rotational start-up of the feeding roll 63 and/or separation roller 21 they are ramped up to at least a minimal operation speed (transport speed) when, preferably before, contacting the sheet 31 to be separated. Furthermore, the start position ensures, that neither separation roller 21 nor feeding roll 63 delivers or feeds any sheet 31.

In case of new start or restart the sensor device checks the alignment position of the separation roller 21 and/or feeding roll 62. To facilitate this the sensor 51 senses the presence of the alignment indication 41. If the sensor 51 detects absence of the alignment indication 41 (angular position of alignment indication 41 is between start position and first angle of rotation $\phi$1) it is assumed that neither the separation roller 21 nor the feeding roll 62 is in contact with a sheet 31 to be separated. Furthermore, it is assumed that the separation roller 21 and thus the feeding roll 42, which is coupled to the separation roller 21, can be rotated against the separation rotational direction s to be set to start position without damaging any sheet 31.

If the sensor detects the alignment indication 41 it is assumed that there might be a sheet in the singling device 2 and/or is fed by the feeding mechanism. If a filling level meter of the sheet store 3 results that there is no sheet in the singling apparatus 1 the feeding roll 42, which is coupled to the separation roller 21, can be rotated against the separation rotational direction s to be set to start position.

If the filling level meter results that there is a sheet in the singling apparatus 1, rotation against separation rotational direction s might lead to jamming. Thus the separation process will start without start position alignment (rotation of separation roller 21 against separation rotational direction s) and starts with singling based on this alignment position.

Using the above described system a start position alignment of the singling apparatus 1, in particular of the separation roller 21 and/or feeding roller 42 is ensured wherein the presence of sheets 31 in the singling device 2 is regarded. Failures on jamming sheets 31 are prevented.

Figure 8:
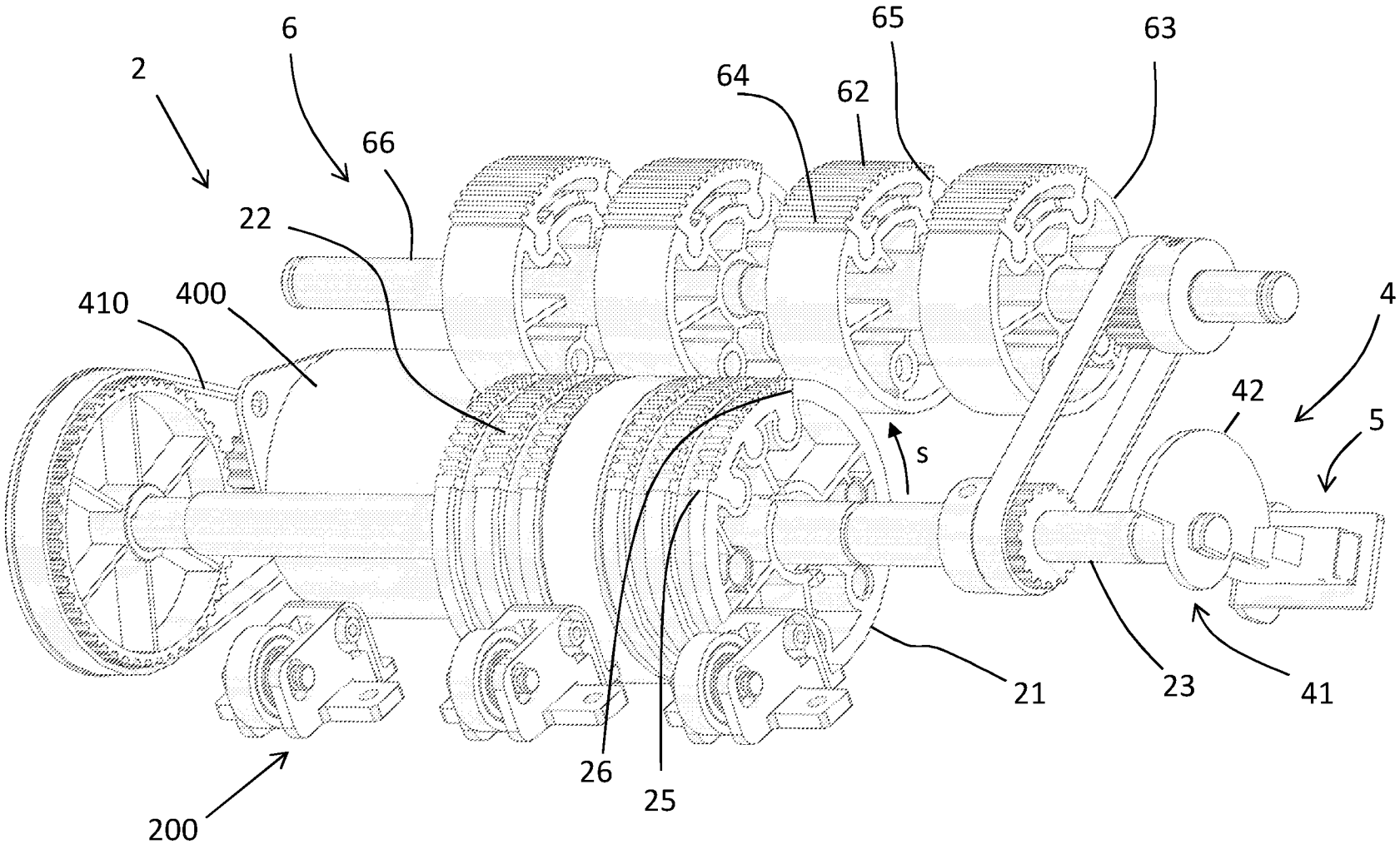
FIG. 8 shows a singling apparatus in perspective view.
Figure 9:
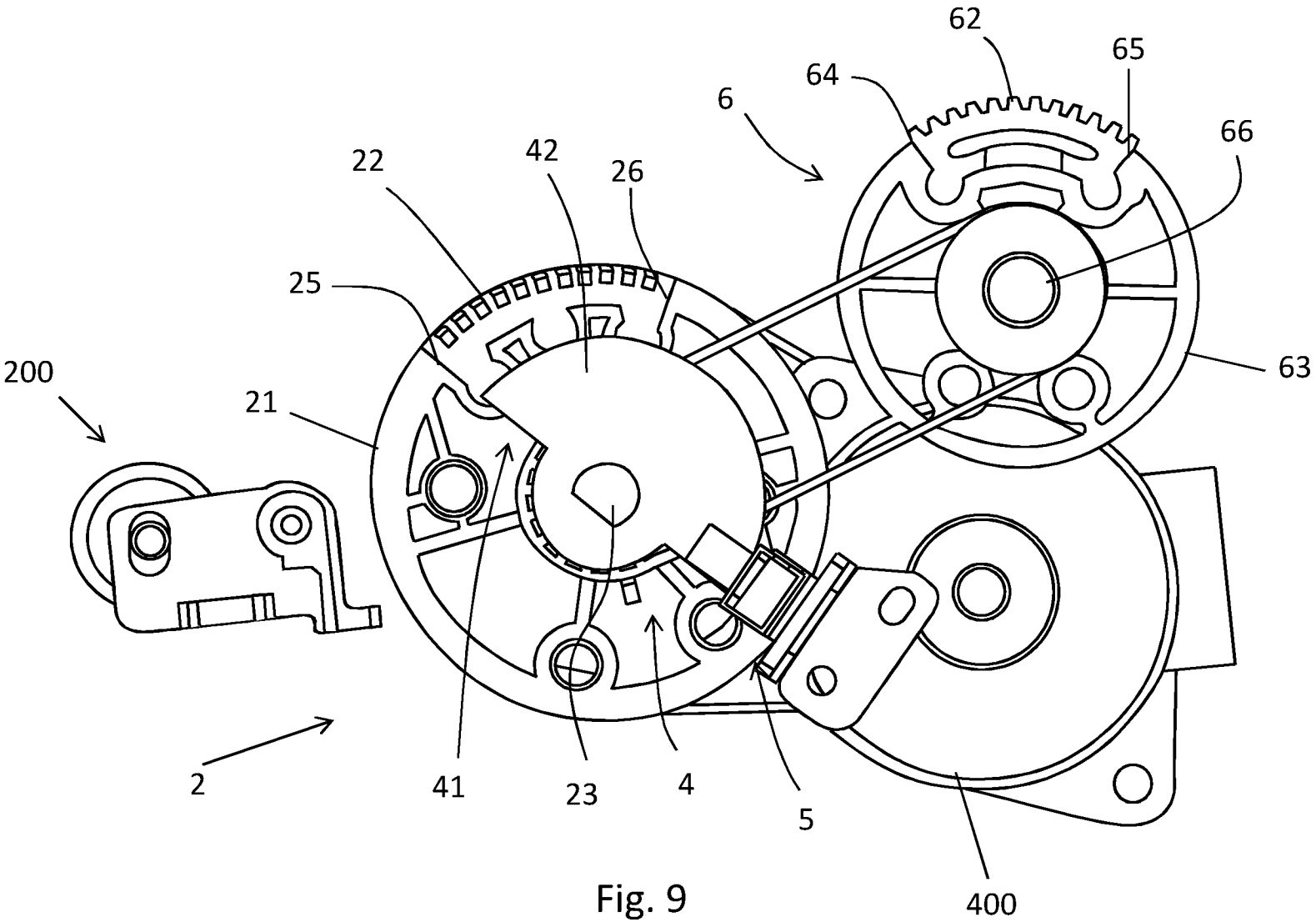
FIG. 9 shows the singling apparatus of FIG. 8 in side view.

FIGS. 8 and 9 show a singling device 2 and a feeding mechanism 6 according to an embodiment of the present invention. This embodiment is similar to the embodiment according to FIGS. 2*a, b*. Some of the differences of the embodiments of FIGS. 8 and 9 are figured out below.

The singling device 2 comprises multiple separation rollers 21. The separation rollers 21 are almost formed like wheels. Each separation roller 21 comprises partially on its circumferential edge a contacting area 22 to contact, to separate and to deliver a sheet to a transport mechanism 200. Each separation roller 21 is mounted on a common axis 23. The axis 23 rotates to separate sheets in a separation rotational direction s. The contacting area 22 has in separation rotational direction s a first end 25 and in counter direction a second end 26.

A position control roller 42 of a position control device 4 is mounted on the axis 23, too and rotates with the rotation of the separation roller 21. The position control roller 42 is formed like a disc. The position control roller 42 comprises a semicircular recess defining an alignment indication 41. The position control device 4 is in combination with a sensor device 5. The sensor device 5 comprises a transmission sensor to detect the presence of the recess, i.e. of the alignment indication 41.

The axis 23 is joined with a motor 400 by a motor belt 410 to drive the axis 23. Furthermore, the axis 23 is coupled with a second axis 66 of a feeding mechanism 6. The second axis 66 bears multiple feeding rolls 63. Each feeding roll 63 has a disc-like structure wherein the center of the feeding roll 63 is mounted on the second axis 66. Further, each feeding roll 63 comprises partially on its circumferential surface a feeding element 62 having in separation rotational direction s a first end 64 and against direction a second end 65.

In this example, the angular extension of the contact area 22 is more than the angular extension of the feeding element 62. The angular position of the first end 25 of the contact area 22 corresponds to the angular position of the first end 64 of the feeding element 62.

The position control device 4 and alignment indication 41 are arranged such that when the separation roller 21 is in an angular alignment in which the contact area 22 does not contact a sheet, the position control device 4 does not detect the presence of alignment indication 41.

In the case of start of the singling apparatus 1 first the sensor device 5 is requested (before singling) to detect alignment indication 41. If the sensor device 5 detects alignment indication 41 the singling apparatus triggers the separation roller 21 to rotate to the start position in a direction against separation rotational direction s. If the sensor device 5 does not detect alignment indication 41 the singling apparatus 1 asks a filling level meter about the amount of sheets in the singling apparatus. If the filling level meter responds that there is no sheet in the singling apparatus the singling apparatus triggers the separation roller 21 to rotate to the start position in a direction against separation rotational direction s. If the filling level meter results that there is at least one sheet in the singling apparatus 1 the singling apparatus notifies e.g. a supervisory system that singler device 2 is not in start position at start-up. The supervisory system and/or singler device 2 might ask for user intervention, in particular to check if a sheet is in the singler devices 2 and to remove it, if necessary and/or ask a user to confirm start singling in current position and/or ask a user to operate manually, e.g. to rotate the separation roller 21 to start position.

While the separation roller 21 rotates against separation rotational direction s the sensor device 5 uses edge detection logic to detect reaching the start position. In doing so the sensor device 5 senses a transition from a status of detecting alignment indication 41 to not-detecting alignment indication 41. The detected transition assumes that start position is reached and the separation roller 21 stops to rotate.

In the embodiment of FIGS. 8 and 9 the angular extension of the alignment indication 41 is 180°. The angular extension of the alignment indication 41 is not a statutory value and may differ. In particular the angular extension may depend on different parameters, e.g. angular extension on contact area and/or tolerance range. Further, the angular alignment of alignment indication 41 is the same as of contact area 22. In another embodiment the angular alignments may differ but are coupled to each other so that their relative angular alignment is equal.

Figure 10A:
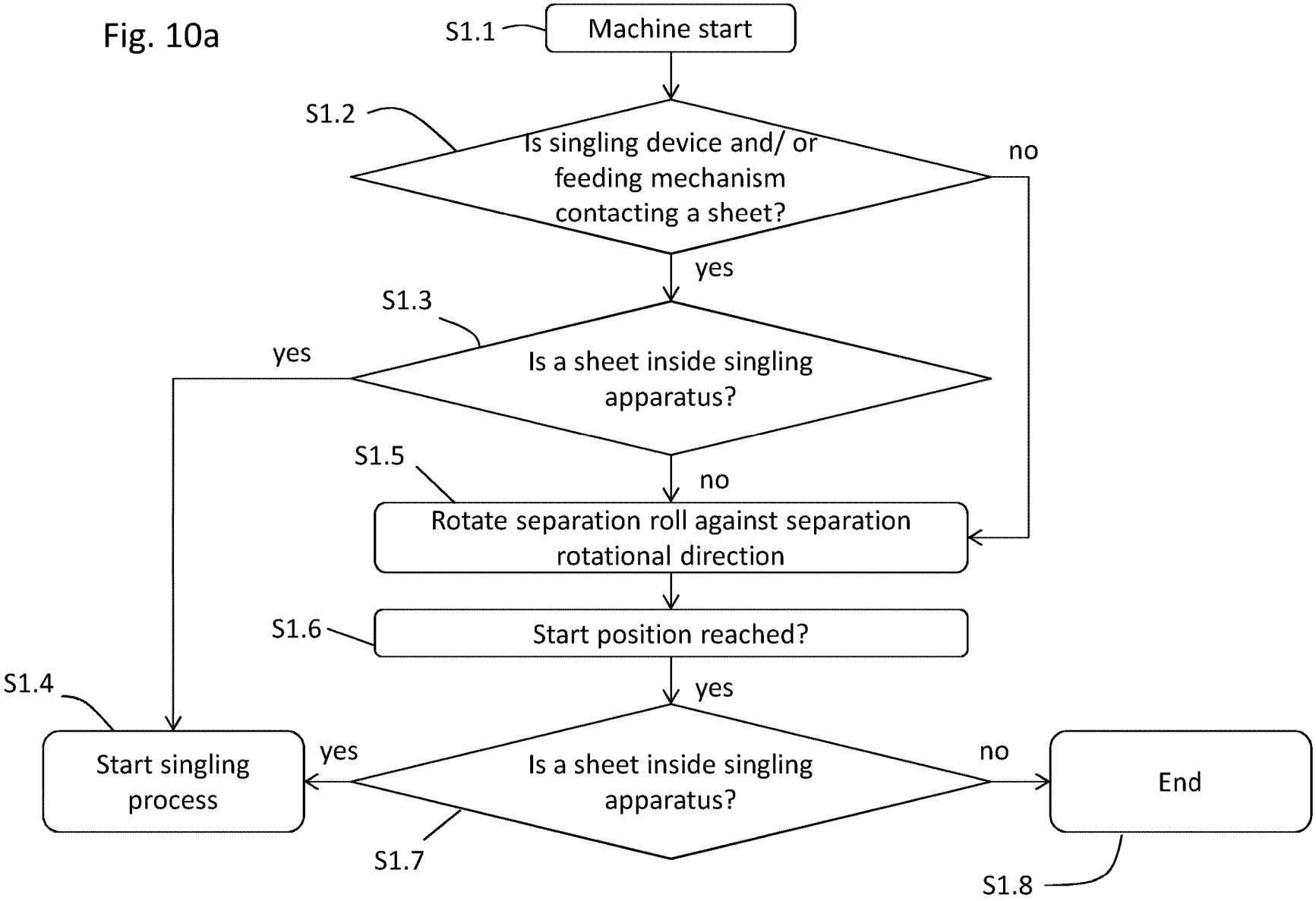
FIG. 10*a* shows a method for singling sheet material according an embodiment of the invention at machine start-up.

FIG. 10*a* shows a schematic diagram of a method for singling sheet material at start-up, i.e. restart, of a singling apparatus and/or singling device. In Step S1.1 the singling apparatus and/or singling device starts to process sheet material. In Step S1.2 the machine senses and evaluates whether a feeding mechanism and/or a singling device is contacting a sheet. If a sheet is contacted the machine checks (S1.3) whether a sheet is inside the singling apparatus, e.g. inside the singling device. In case there is any sheet in the singling apparatus and/or singling device, the singling apparatus starts with singling process (S1.4).

If neither the singling device nor the feeding mechanism contacts a sheet nor a sheet is in the singling apparatus, the machine, i.e. the singling apparatus, rotates (S1.5) a separation roll of the singling device against separation rotational direction until a start position is reached (S1.6). Then the machine checks if there is a sheet inside the singling apparatus (S1.7). Subsequently, if there is a sheet to be separated in the singling apparatus the machine starts with singling process (S1.4). Otherwise the machine stops and end process (S1.8)

Figure 10B:
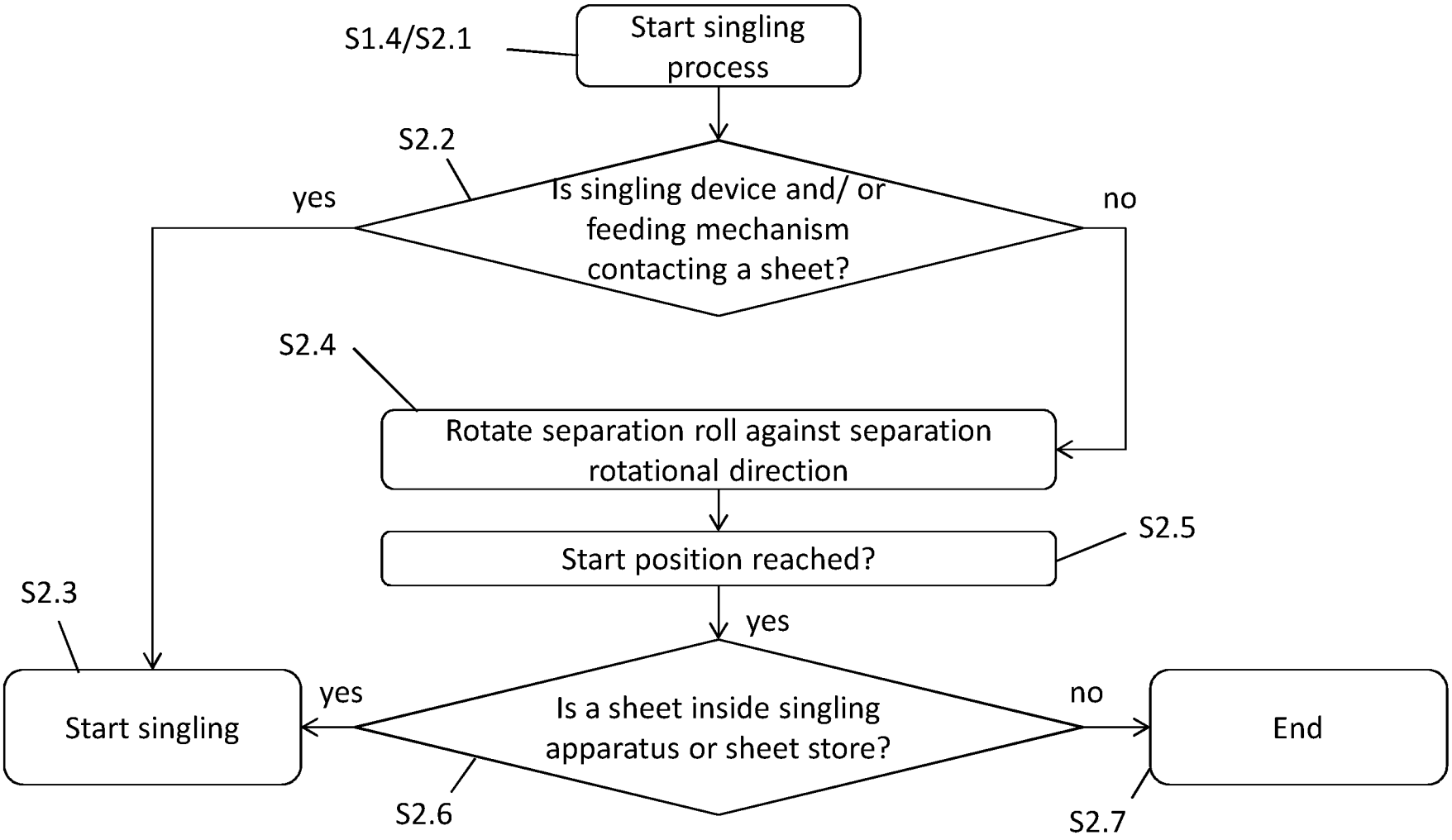
FIG. 10*b* shows a method for singling sheet material according an embodiment of the invention before start of singling.

FIG. 10*b* shows a method for singling a sheet material after a break, in particular break down, or during sheet processing of the apparatus but before its singling process. The shown method may follow up the method shown in FIG. 10*a* but may exist without the process according to FIG. 10*a*.

For better and simple understanding the method shown in FIG. 10*b* starts with singling process S1.4/S2.1, e.g. according to FIG. 10*a*. Afterwards, in Step 2.2 the singling apparatus senses and evaluates if a feeding mechanism and/or a singling device are contacting a sheet. If the evaluation of Step S2.2 results that the feeding mechanism and/or singling device is contacting a sheet the singling apparatus starts immediately with singling (S2.3). Otherwise, if the evaluation (S2.2) results that the feeding mechanism and/or singling device do not contact a sheet in Step 2.4 the separation roll rotates against separation rotational direction until start position is reached. When the separation roll is aligned in start position (S2.5) the singling apparatus starts with singling (S2.3).

In an embodiment after step S2.5 but before step 2.3 there may be a step S2.6 to evaluate whether there is a sheet inside the singling device and/or sheet store to be separated. If there is a sheet to be separated the process continues with Step S2.3. Otherwise, in a preferred embodiment, the process ends (S2.7).

In an embodiment after step S2.3 the process continues with step S2.1. In a further embodiment step S2.2 is optional and is omitted, at least at first loop after step S1.4 but may be mandatory after step S2.1.

Figure 10C:
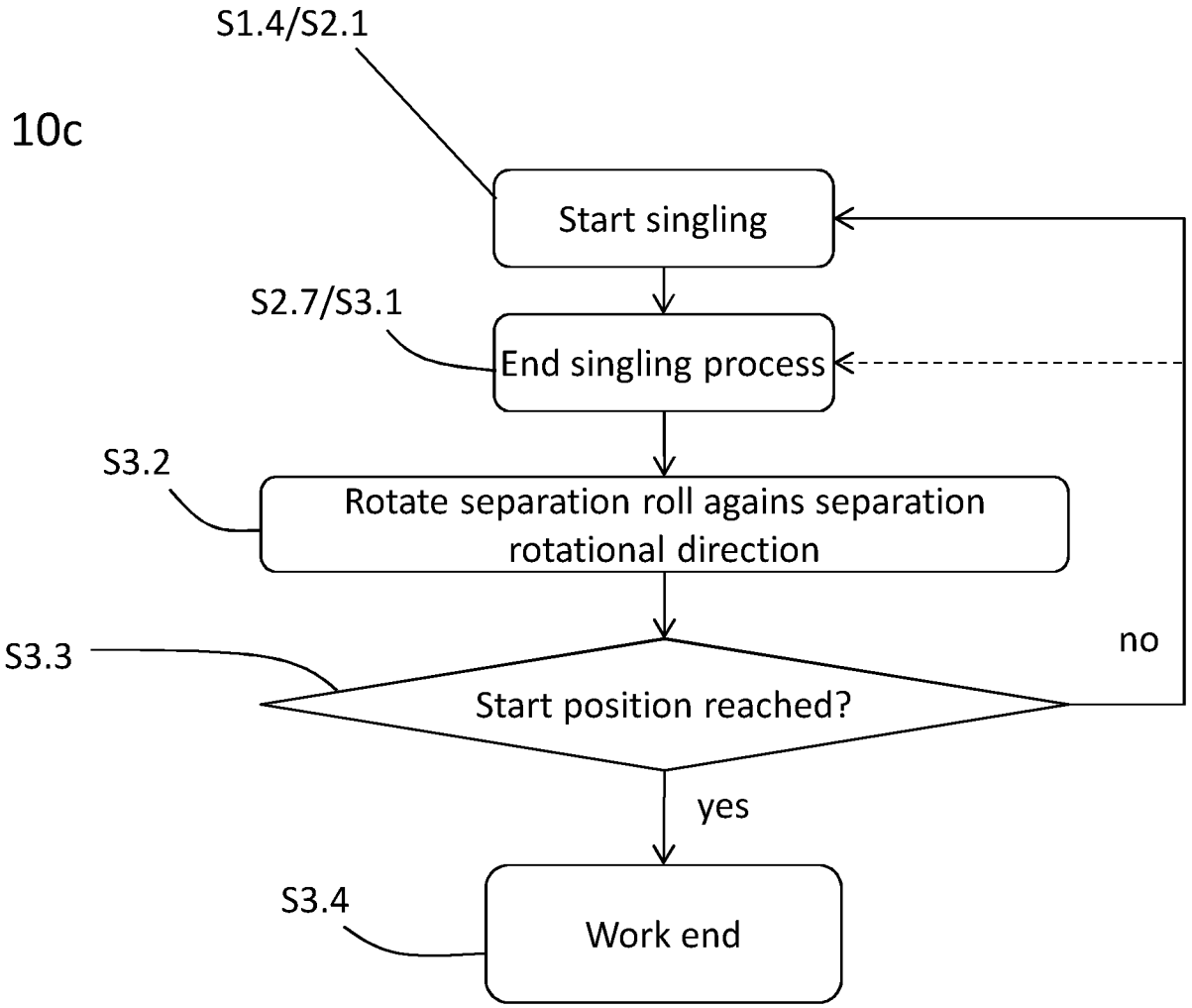
FIG. 10*c* shows a method for singling sheet material according an embodiment of the invention at the end of singling.

FIG. 10*c* shows a process according to present invention after singling a sheet material, e.g. after singling process. This may be the case, when there is no further sheet to be singled and/or apparatus break down. The shown method follows up to the method shown in FIGS. 10*a, b* but may exist without at least one of preprocesses in FIGS. 10*a, b*.

In Step S2.7/S3.1 singling of sheets or the singling process is ended. E.g. this may be in result that a filling level meter doesn't detect any sheet in a sheet store of the singling apparatus, i.e. all sheets in the sheet store are singularized and delivered to a transport mechanism for further processing.

When the end of singling process is detected (S2.7/S3.1) the separation roll is rotated against separation rotational direction (S3.2) until the start position is reached (S3.3). When the start position is reached work of singling apparatus is ended (S3.4). If start position is not reached process continues either with step S2.1 or step S3.1. In a further embodiment a uses will be informed that start position is not reached. Further actions, e.g. manual operations or immediate apparatus stop can follow.

In an embodiment step S3.2 can be omitted if separation roll is already in start position.

Figure 11A:
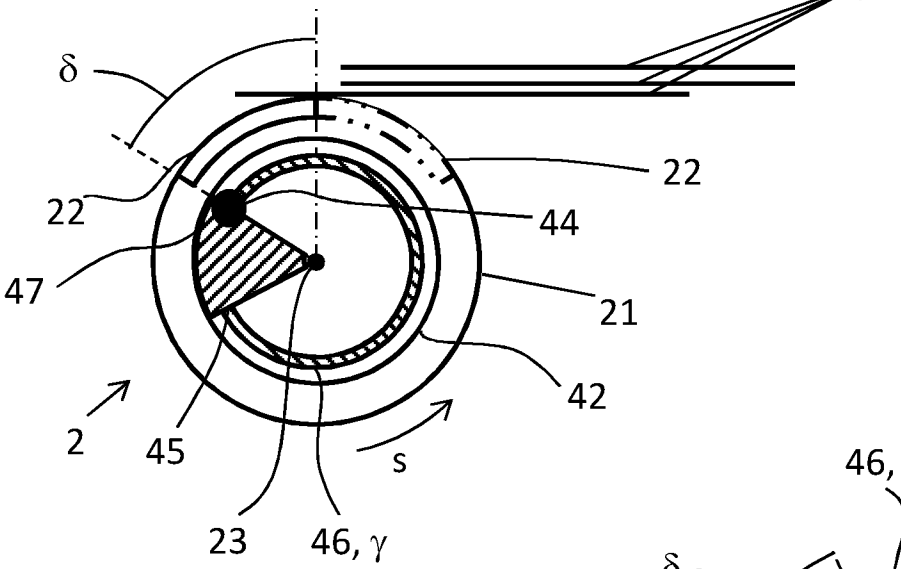
FIG. 11*a* shows schematically a method to design a singling apparatus according an embodiment of the invention.

FIG. 11*a* shows schematically a design of a singling device 2 in accordance with an embodiment of the present invention. The singling device 2 comprises a separation roller 21 adapted to rotate around an axis 23. The separation roller 21 comprises on its circumferential surface a frictional contact area 22 having a circular extension δ. The contact area 22 shown in continuous line represents a situation when the contact area 22 is just not contacting a sheet 31 anymore, e.g. the contact area 22 has just delivered a sheet 31. The contact area 22 shown in dot-dashed line shows the contact area 22 in a situation when the contact area just contacts a sheet 31 at first time for separation and delivering. The rotation direction of the separation roller 21 when delivering the sheet 31 is marked with arrow s.

The separation roller 21 comprises an integrally formed position control roller 42. The position control roller extends on the front side of the separation roller 21 and comprises a recess 46, formed radially around the axis 23. The radially extension γ of the recess 46 corresponds to a circular extension of 360°-δ. The recess 46 acts as an alignment indication.

A first end 44 of the recess 46 is defined at an end of the recess in direction s. A second end 45 of the recess 46 is defined at an end of the recess 46 against direction s. A point-formed in preferable stationary light source 47 of a sensor device is arranged so that its light is able to shine through the recess 46. In particular, in the present application at an alignment position of the separation roller 21 wherein the contact area 22 is in position shown with continuous line, the light source 46 shines through the recess 46 just at the first end 44. When the separation roller 21 rotates in separation direction S, the light will continuously shine through the recess 46 until the contact area 22 contacts the sheet 31 (shown in dot-dashed line). When contacting the sheet 31, the light of light source 46 exceeds second end 46, i.e. the light does not shine through recess 46.

A detection unit (not shown) may be positioned to detect whether light is passing through the recess 46. So the detection unit may detect the relative angular position of the separation roller 21, in particular whether the contact area 22 is in an angular position to contact the sheet 31. In case the detection unit detects light shining through the recess 46 it is assumed that contact area 22 does not contact the sheet 31. Then, as long as the detection unit detects light passing through the recess 46 the sheet 31 won't get crumbled when separation roller 21 is rotating against direction s. Rotation against direction s should be stopped when light exceeds first end 44 and detection of light transmits to non-detection. The case of non-detection of light represents an angular position of separation roller 21 in which rotation against direction S should be carefully verified.

The extension of γ of the recess 46 depends amongst others on the size of the contact area 22 and radial distance of the contact area 22 to the axis 23 (see FIG. 10*b*). Furthermore the extension γ of the recess can include a safety distance, e.g. a distance from the position when the contact area 22 just does not contact the sheet after delivering a sheet (first end 44) or a distance from the position when the contact area 22 just does not contact the sheet before delivering a sheet (second end 45). In first case, the first end 44 of the recess 46 is located in a direction against direction s and in the second case, the second end 45 of the recess 46 is located in direction s. In both cases the extension of γ becomes smaller.

To detect the alignment position of separation roller 21, in particular of contact area 22, there may be multiple alternatives in the scope of the invention to be used as alignment indication. For example, the position of the recess 46 is variable. Hence, the orientation of the detection unit and/or the light source 45 has to be adapted to the position of the recess 46. Furthermore, instead and/or in addition to the recess 46 there may be any other design to detect a local presence. For example a route of electrical conductive material can be used, wherein the detective unit senses the presence of the conductive material. Furthermore the recess 46 or other may be positioned at a separate position control roller, coupled to the separation roller 21.

Figure 11B:
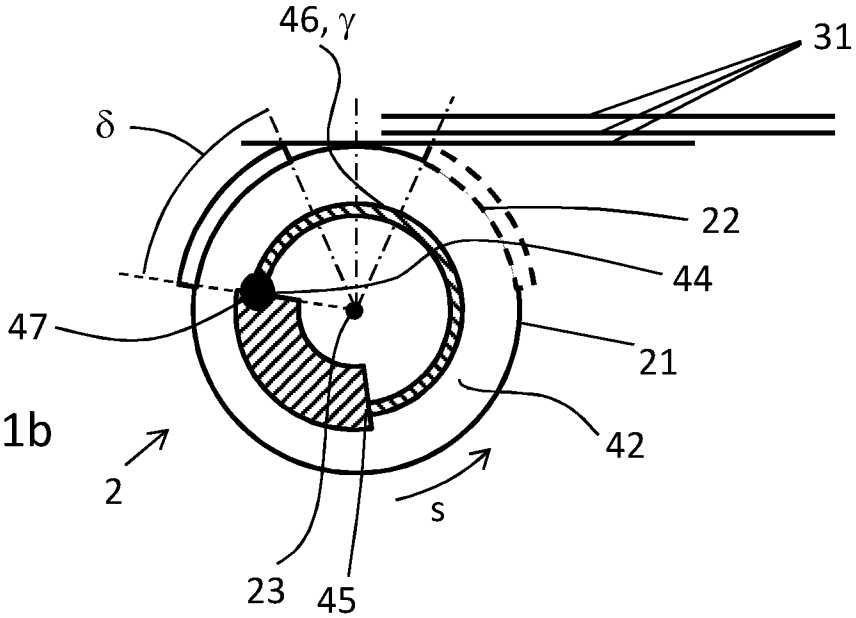
FIG. 11*b* shows schematically a method to design a singling apparatus according another embodiment of the invention.

The above described methods may contain additional steps, e.g. to evaluate that the feeding mechanism and/or singling device is contacting a sheet. The steps are described in any combination with FIG. 1 to 9 or 11*a, b* and may be transferred in the method described in any of FIGS. 11*a-c*. It should be obvious that other embodiments e.g. alternative methods to sense the status of contacting the sheet by the separation roller and/or the feeding roll, are included in the present invention. In particular different methods to determine the position of the alignment indication, e.g. with the help of optical, electrical and/or acoustical sensors, are possible. For example it should be independent if the presence of alignment indication is detected or its non-presence. The same applies to the devices and/apparatus shown in FIGS. 1 to 9 and 11*a, b*.

The invention claimed is:

1. A singling apparatus for singling sheet material, the singling apparatus comprising:

a sheet store for receiving a sheet stack of sheets to be singled, wherein the sheet store includes a singling gap, said singling gap being formed and arranged to deliver a sheet out of the sheet store to a transport mechanism;

a singling device comprising a separation roller, the separation roller comprising partially on its rotational surface a contact area to periodically contact and transport the sheet from the sheet store to the transport mechanism; and a position indication device coupled to the separation roller and comprising an alignment indication arranged in correlation with an angle position of the contact area of the separation roller, the alignment indication indicating an alignment of the contact area relative to the singling gap and/or the sheet;

wherein the position indication device is arranged on the separation roller.

2. The apparatus according to claim 1, wherein the position indication device comprises a position control roller, wherein the alignment indication is arranged on the position control roller.

3. The apparatus according to claim 2, wherein the alignment indication is integrally formed with the position control roller.

4. The apparatus according to claim 1, wherein the contact area is adapted to contact the sheet, the contact area and a rotation axis of the separation roller defining an angle of contact, and a spatial extension of the alignment indication and a center of the position indication device defining an angle of alignment, wherein the angle of contact correlates with the angle of alignment.

5. The apparatus according to claim 4, wherein a degree of the angle of alignment is equal to or more than a degree of the angle of contact.

6. The apparatus according to claim 1, wherein the alignment indication comprises one or more of:

a cavity;

a recess;

a reflecting area;

an area of a material thinning;

an area of a material compacting;

a magnetic marking;

an electrical marking;

a colored marking, comprising color pigments, luminescent pigments and/or phosphorescent pigments;

and a special state of surface different to surrounding area of the alignment indication.

7. The apparatus according to claim 6, wherein the special state of surface different to surrounding area of the alignment indication comprises a difference in surface roughness.

8. The apparatus according to claim 1, wherein the alignment indication forms a circular arc or a segment of a circle or a combination thereof with a center of the position indication device.

9. The apparatus according to claim 1, further comprising a sensor device to identify an alignment of the alignment indication.

10. The apparatus according to claim 9, wherein said alignment of the alignment indication comprises an angular position of the alignment indication and/or presence of the alignment indication at a defined position.

11. The apparatus according to claim 1, further comprising a feeding mechanism configured to move the sheets to the singling gap, synchronous with an angular velocity of the separation roller.

12. The apparatus according to claim 11, wherein a geometry of the alignment indication is adapted to indicate a state of the feeding mechanism.

13. The apparatus according to claim 12, wherein the state of the feeding mechanism indicated by the geometry of the alignment indication comprises a determination whether the feeding mechanism is in contact with and/or feeds the sheets.

14. The apparatus according to claim 11, wherein the feeding mechanism comprises an air feeding mechanism and/or a feeding roller.

15. The apparatus according to claim 1, wherein the position indication device is integrally formed with the separation roller.

16. The apparatus according to claim 1, wherein the sheet store comprises a level measurement device.

17. A method for singling sheet material in a singling apparatus comprising:

a sheet store for receiving a sheet stack of sheets for singling, a singling device comprising a separation roller, said separation roller comprising partially on its rotational surface a contact area to periodically contact and/or transport a sheet for separation out of the sheet stack with rotation of the separation roller in a transport rotary direction; and a position indication device coupled to the separation roller and comprising an alignment indication arranged in correlation with angular alignment of the contact area and indicating alignment of the contact area to the sheet;

wherein the method comprises the steps:

a) sensing a position of the alignment indication of the position indication device;

b) evaluating the position of the alignment indication to determine whether the contact area is in contact with the sheet;

c) where the evaluation in step b) determines that the contact area is not contacting and/or not transporting the sheet rotating the separation roller against the transport rotary direction until the separation roller is aligned to a start position, wherein the start position is defined as an angular position in which after starting to rotate the separation roller in transport rotary direction it is assured that when the contact area contacts the sheet the separation roller will have a predefined minimum angular velocity;

d) rotating the separation roller in the transport rotary direction to start singling the sheet from the sheet store.

18. The method according claim 17, wherein, when rotating the separation roller against the transport rotary direction, reaching the start position of the separation roller is indicated by the position indication device.

19. The method according to claim 17, wherein the position indication device is rotatably arranged and coupled to the separation roller, the alignment indication of the position indication device configured to rotate around an axle of the position indication device and an angular velocity and/or angular position of the alignment indication configured to correlate with an angular velocity and/or angular position of the separation roller, respectively.

20. The method according to claim 17, wherein the singling apparatus further comprises a filling level meter determining a filling level of the sheet store;

the method further comprising:

c1) where if the evaluation in step b) determines that the contact area is in contact with the sheet and/or is transporting the sheet, and the filling level of the sheet store results that there is no sheet to be singled, rotating the separation roller against the transport rotary direction until the separation roller is aligned to the start position; or c2) where the evaluation in step b) determines that the contact area is in contact with the sheet and/or is transporting the sheet, and the filling level of the sheet store determined by the filling level meter results that there is one or a plurality of sheets to be singled, rotating the separation roller in the transport rotary to start singling the sheet from the sheet store according to step d) without rotating the separation roller against the transport rotary direction.

* * * * *